US006651579B1

(12) United States Patent
Wynne et al.

(10) Patent No.: US 6,651,579 B1
(45) Date of Patent: Nov. 25, 2003

(54) PERSONAL WATERCRAFT HAVING TUNEABLE SPONSONS

(75) Inventors: Dallas B. Wynne, Spirit Lake, IA (US); Bradley R. Morisch, Okoboji, IA (US)

(73) Assignee: Polaris Industries Inc., Medina, MN (US)

( * ) Notice: Subject to any disclaimer, the term of this patent is extended or adjusted under 35 U.S.C. 154(b) by 0 days.

(21) Appl. No.: 10/244,814

(22) Filed: Sep. 16, 2002

(51) Int. Cl.[7] ..... B63B 1/22

(52) U.S. Cl. ..... 114/284; 114/55.54; 114/126; 114/343

(58) Field of Search ..... 114/56.1, 55.5, 114/55.54, 284, 123, 126, 129, 343

(56) References Cited

U.S. PATENT DOCUMENTS

| | | | | | |
|---|---|---|---|---|---|
| 31,563 | A | | 2/1861 | Seibert et al. | 172/282 |
| 731,515 | A | | 6/1903 | Sheen et al. | 114/364 |
| 998,437 | A | | 7/1911 | Wieland | 114/284 |
| 2,448,075 | A | | 8/1948 | Bortner | 244/102 R |
| 2,919,669 | A | | 1/1960 | Kikuhara | 114/284 |
| 3,369,518 | A | | 2/1968 | Jacobson | 114/123 |
| 3,481,297 | A | | 12/1969 | Mantle | 114/67 |
| 3,485,198 | A | | 12/1969 | Matthews | 114/123 |
| 3,648,641 | A | | 3/1972 | Normand, Jr. | 114/123 |
| 3,702,106 | A | | 11/1972 | Wilder | 114/123 |
| 3,707,936 | A | | 1/1973 | Harris | 114/126 |
| 4,320,713 | A | | 3/1982 | Nishida et al. | 114/123 |
| 4,690,094 | A | | 9/1987 | Taylor | 114/284 |
| 4,896,621 | A | * | 1/1990 | Coles | 114/284 |
| 4,907,520 | A | * | 3/1990 | Pipkorn | 114/61.3 |
| 4,942,837 | A | | 7/1990 | Hellmann et al. | 114/40 |
| 4,947,781 | A | * | 8/1990 | Norman | 114/55.54 |
| 4,964,357 | A | | 10/1990 | Genfan | 114/274 |
| 5,544,607 | A | | 8/1996 | Rorabaugh et al. | 114/123 |
| 5,713,297 | A | * | 2/1998 | Tani et al. | 114/284 |
| 5,908,006 | A | * | 6/1999 | Ibata | 114/284 |
| 6,032,605 | A | * | 3/2000 | Takashima | 114/284 |
| 6,041,727 | A | * | 3/2000 | Yamada et al. | 114/123 |
| 6,105,527 | A | | 8/2000 | Lochtefeld et al. | 114/125 |
| 6,523,490 | B1 | * | 2/2003 | Watkins | 114/55.54 |
| 6,546,884 | B1 | * | 4/2003 | Rodriguez | 114/55.5 |
| 6,546,888 | B2 | * | 4/2003 | Bertrand et al. | 114/126 |

* cited by examiner

*Primary Examiner*—S. Joseph Morano
*Assistant Examiner*—Lars A. Olson
(74) *Attorney, Agent, or Firm*—Fredrikson & Byron, P.A.

(57) ABSTRACT

Tunable sponsons for personal watercraft and personal watercraft having the tunable sponsons. The present invention provides personal watercraft having sponsons with an adjustable height relative to the water surface and the hull. One adjustable sponson has a horizontally, outwardly extending portion from the personal watercraft hull followed by a downwardly extending portion including a fin for penetrating below the water surface. The effective height of the sponson outwardly extending portion above the water can be reduced or lowered by adding a thickness of slab of material along the length under the sponson outwardly extending portion. One tunable sponson includes apertures mounted along the sponson underside for securing additional material. The effective height of the sponson horizontally extending portion above the water can be increased by removing a removable sponson extension previously secured to the sponson. The present invention further includes methods for adjusting the handling characteristics of a personal watercraft by adding and removing thicknesses of material from under the sponson.

17 Claims, 2 Drawing Sheets

PERSONAL WATERCRAFT HAVING TUNEABLE SPONSONS

FIELD OF THE INVENTION

The present invention is related generally to personal watercraft. More specifically, the present invention is related to personal watercraft having adjustable sponsons.

BACKGROUND OF THE INVENTION

Personal watercraft have become increasingly popular in recent years. A personal watercraft, also known as a "jet ski" typically has a bottom hull, handle bars for steering, a tunnel within the bottom hull, a jet pump located within the bottom tunnel, and an engine within the hull under the top deck for driving the jet pump. The jet pump typically pulls in water from the front of the tunnel under the boat, and discharges the water at high velocity through a steerable nozzle at the rear of the boat. The handle bars are typically coupled to the nozzle, which is the steering mechanism for the personal watercraft. The watercraft commonly has a straddle-type seat and foot wells disposed on either side of the seat.

Early watercraft often had longitudinal chines running underneath the bottom hull, and sometimes had steps located in the rear portion of the bottom hull, for reducing porpoising by extending the length of the boat while not extending the length of wetted surface. Steering, as previously indicated, was primarily effected by turning the handle bars coupled to the nozzle, which could be steered from side to side to direct the water jet in the desired direction and thereby steer the personal watercraft. The steerable nozzle sometimes had a small rudder on the nozzle, also for aiding in steering the watercraft.

Early personal watercraft sometimes skidded around corners wider than the driver desired. Sometimes, boats would turn 180°, despite the driver's intent to make a sharp 90° turn. This lack of control at high speeds during aggressive maneuvers was later addressed by adding sponsons to the personal watercraft.

The term "sponson" has come to have different meanings in different contexts. Historically, sponsons were floatation devices or outriggers for stabilizing a boat in rough water. The sponsons could be lowered to stabilize a boat in rough water, for example, while fishing. The sponsons could be later raised for traveling through the water. The term sponson has also been used to refer to the outrigger on an outrigger canoe. As used in the personal watercraft industry, and as used in the present application, the term sponson refers to a device having a generally hydrodynamic shape to aid the watercraft in stabilizing straight ahead progress through the water and to aid in executing turns in the water. The personal watercraft sponsons are dimensioned and configured to have a fin or blade having an outwardly extending edge that penetrates below the water level during normal use. The personal watercraft's sponson will penetrate below the water surface when the personal watercraft is at rest, in calm water, even with no rider on board. The sponson typically has an outwardly extending lower surface that rides on the water when the boat is planing.

Sponsons provide lift at the rear of the personal watercraft, acting to force the nose down to provide a degree of aggressiveness. Sponsons that provide harder, sharper cornering often also provide decreased straight line stability. The more aggressive design often has a "tippy" feeling when the rider shifts their weight. This tippy feeling is accepted by experienced drivers, but maybe unsettling to experienced drivers. Sponsons are typically designed together with the personal watercraft hull, for a particular model and year. Various considerations go into the hull and sponson design, including the desired degree of stability, desired lift provided by the sponson, and the degree of aggressiveness desired for that model and model year. Different drivers desiring different features can select varying personal watercraft having the desired handling characteristics.

What would be desirable are personal watercraft having sponsons which can vary according to the desired handling characteristics of the driver. What would be advantageous are sponsons which can be changed from an aggressive handling mode to a gentler riding mode.

SUMMARY OF THE INVENTION

The present invention provides tunable sponsons for personal watercraft and watercraft having these tunable sponsons. Sponsons according to the present invention can be adjusted or "tuned," by adjusting the effective height of the lower surface of a horizontally extending portion of the sponson relative to the water. One tunable sponson includes a horizontally or outwardly extending portion, followed by a downwardly extending fin portion, terminating in a fin edge for penetrating beneath the water surface. The lower surface of the sponson can include apertures for mounting an additional material thickness under the sponson.

One tunable sponson includes a horizontal underside having threaded apertures for receiving mounting bolts for securing an additional thickness or slab of material under the existing lower horizontal surface of the sponson. The effective height of the sponson lower horizontal surface relative to the water can be decreased or lowered by increasing the thickness of the sponson material. The additional thickness or slab of material may also be referred to as a sponson extension. The effective height of a tunable sponson lower horizontal surface may be increased or raised by removing a previously installed thickness of sponson extension material.

The present invention provides sponsons which can have the sponson height relative to the water increased or decreased to match the driver's experience level, the driver's desires of the moment, the passenger load, as well as the expected water conditions. The tunable sponsons thus allow the driver to configure their own handling characteristics moment by moment, rather than having these characteristics dictated by the manufacturer.

DETAILED DESCRIPTION OF THE PREFERRED EMBODIMENTS

The following detailed description should be read with reference to the drawings, in which like elements in different drawings are numbered identically. The drawings, which are not necessarily to scale, depict selected embodiments and are not intended to limit the scope of the invention. Several forms of invention have been shown and described, and other forms will now be apparent to those skilled in art. It will be understood that embodiments shown in drawings and described above are merely for illustrative purposes, and are not intended to limit scope of the invention as defined in the claims that follow.

Figure 1:
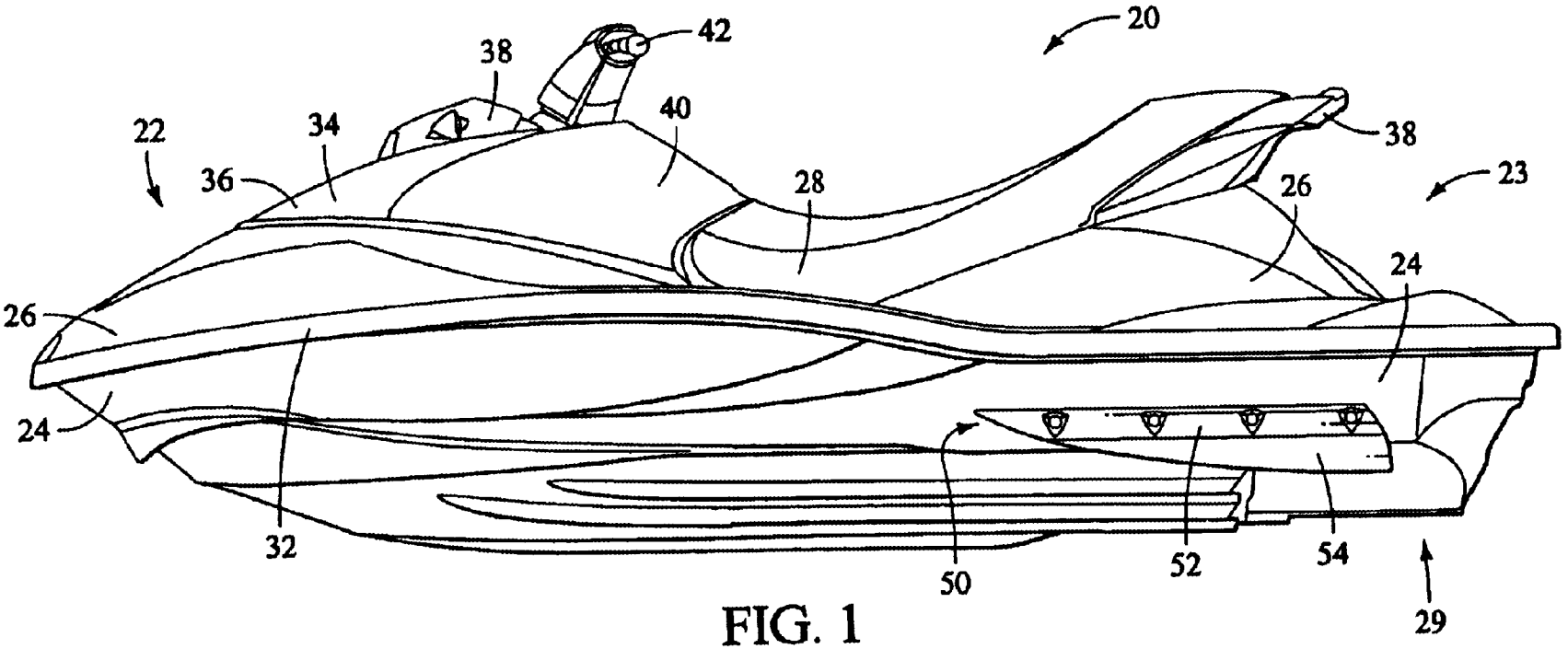
FIG. 1 is a side view of a personal watercraft having a tunable sponson.

FIG. 1 illustrates a personal watercraft 20 having generally a front or bow 22 and a rear or stern 23. Personal watercraft 20 includes a bottom hull 24 secured to a top deck 26 along an overlapping portion covered with a rub rail 32 in the embodiment illustrated forming a hull. A hood 34 may also be seen, joined to top deck 26 at a hinged front hood portion 36. The hull formed by the bottom hull 24 and top deck 26 define a compartment sized to contain an internal combustion engine for powering the watercraft, and may also include one or more storage compartments, depending upon the size and configuration of the watercraft. The deck portion 26 also has a raised, longitudinally extending seat 28 adapted to accommodate one or more rider seated in straddle fashion on the seat 28. A grab handle 38 is disposed transversely across the rear of the seat. The engine powers ajet propulsion unit 29, typically mounted in a tunnel at the bottom rear portion of the watercraft. The jet propulsion unit 29 includes a steerable water discharge nozzle that is operatively connected to a set of handlebars 42 to facilitate steering of the watercraft by the operator. The handlebars 42 typically mount through a top portion of a shroud 40. The connection between the handlebars 42 and the discharge nozzle may be of any suitable type, and typically includes mechanical linkages including a control cable. If desired, an electronic connection could also be utilized.

A tunable sponson 50 may be seen secured along a longitudinal portion of the bottom hull 24. Tunable sponson 50 includes generally a horizontally extending portion 52 and a vertically extending portion 54. A tunable sponson may of course have a curved configuration including both horizontally and vertically extending components being formed as one continuous curve. Horizontally extending portion 52 may be seen to extend transversely outward from hull 24 while vertically descending portion 54 may be seen to extend a particular depth downward with respect to the bottom hull 24.

Figure 2:
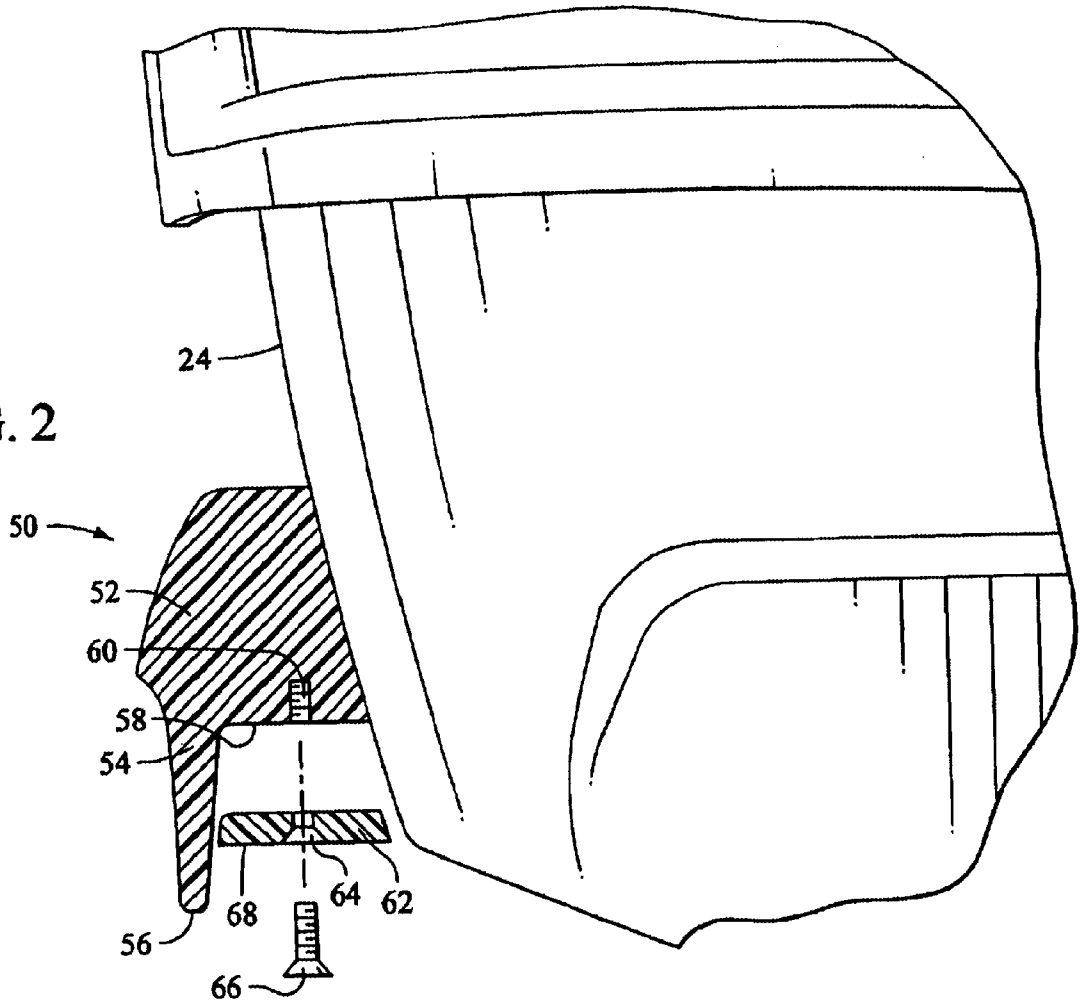
FIG. 2 is a fragmentary, rear, transverse, cross-sectional view of the personal watercraft tunable sponson of FIG. 1, having a removable bottom surface material.

FIG. 2 illustrates a rear, transverse, cross-sectional view of tunable sponson 50. Tunable sponson 50 may be seen to include outwardly extending sponson portion 52 that extends generally horizontally from the bottom hull 24. Sponson 50 also includes downwardly extending sponson portion 54 that extends generally vertically at a position outward of portion 52. Sponson downwardly extending portion 54 may also be referred to as a sponson fin or blade, terminating in a downward-most edge 56. Fin 54 and edge 56 are typically configured, dimensioned, and mounted on hull 24 such that when the personal watercraft is at rest, with no passengers on-board, and in calm water, fin 54 is at least partially submerged in water and fin downward edge 56 is even further submerged beneath the water surface. Fin 54 thus acts as a fixed rudder, rather than as a flotation device. Outwardly extending portion 52 may be seen to have a lower surface 58, located a given height or distance above the water and preferably above the lowermost extent of hull 24. Sponson lower surface 58 is often set at a height to ride on the water when the personal watercraft is at plane. Sponson lower surface 58 may be seen to have an aperture 60 therein for securing a sponson extension, described below. In a preferred embodiment, aperture 60 is threaded to receive a mounting bolt.

A sponson extension 62 may also be seen in FIG. 2, including a mounting aperture 64 therethrough for receiving a mounting bolt 66 which can extend through the sponson extension 62 and into the sponson outwardly extending portion 52. Sponson extension 62 may be seen to have a thickness as well as an extension lower surface 68. The effective height of the sponson lower surface relative to the water thus has one value when extension 62 is secured to outwardly extending portion 52, and another when extension 62 is removed. The effective lower surface height of the tunable sponson can thus be adjusted or "tuned" by adding or removing sponson extensions. Lowering the effective height of the sponson water facing or water riding surface can provide greater lift from the sponson.

In various embodiments, sponson extensions can have various shapes, including a slab-like shape having a longitudinal length dimensioned to substantially match the longitudinal length of the outwardly extending sponson portion 52 along the side of the bottom hull 24. The slab-like shape also may have a width dimensioned to substantially match the width of the existing sponson lower surface 58 extending outwardly from the bottom hull 24. With respect to thickness of depth (measured downwardly or vertically in the view shown in FIG. 2), sponson extension 62 can have thicknesses (or depth) of ⅛ inch, ¼ inch, ½ inch, ¾ inch, 1 inch, and even 2 inches. In one embodiment, sponson extension 62 has a thickness of between about ¼ inch and 1 inch. Sponson extension 62 can be formed of any suitable material, including polypropylene or an engineered plastic.

In the embodiment shown in FIG. 2, sponson extension 68 is mounted to the underside 58 of sponson 52 via a mounting bolt 66 that extends through a mounting aperture 64 and into engagement with a threaded aperture 60 in the sponson. In addition to the mounting bolt 66 configuration, persons of average skill in the art will recognize that other equivalent removable mounting mechanisms (e.g., interlocking components, brackets, adhesives, etc.) may be used to mount the sponson extension 68 or a series of sponson extensions 68 to the sponson.

The present invention includes a method for tuning or adjusting the height of the sponson horizontally extending lower surface portion relative to the water. The effective height of the sponson lower surface can be raised by removing an extension, and lowered by adding an extension to the existing sponson. More than one extension may be added in some embodiments.

A driver can add a sponson extension to lower the water riding surface of the sponson to create more lift. Creating more lift can act to raise the stern and lower the bow, making the watercraft a more aggressive, tighter cornering machine. The driver can also remove sponson extensions to reduce the lift, making the watercraft a gentler handling machine.

What is claimed is:

1. A jet-propelled personal watercraft comprising:

a hull having a bottom hull and a top deck secured over the bottom hull, the bottom hull having a lowermost extent, the hull defining an engine compartment sized to contain an internal combustion engine for powering a jet propulsion unit, the top deck having a raised, longitudinally extending seat adapted to accommodate an operator in straddle fashion;

a sponson mounted on each side of the bottom hull, the sponsons having a fin for penetrating beneath the water, the sponsons including an outward portion having a lower surface extending outwardly from the bottom hull, the outward portion lower surface positioned at a height above the lowermost extent of the bottom hull; and a sponson extension removably mounted under the outward portion lower surface, the sponson extension having a lower surface, whereby at least a portion of the sponson extension lower surface is positioned lower than the sponson outward portion lower surface.

2. The jet-propelled watercraft of claim 1, wherein the sponson extension lower surface is positioned at a height above the lowermost extent of the bottom hull.

3. The jet-propelled watercraft of claim 1, wherein the sponson extension is removably mounted under the sponson outward portion by securing a screw through the sponson extension and into an aperture in the sponson outward portion.

4. The jet-propelled watercraft of claim 1, wherein the sponson extension has a thickness of between about ¼ inch and 1 inch, the sponson extension lower surface being positioned lower than the sponson outward portion lower surface by an amount equal to the sponson extension thickness.

5. A jet-propelled personal watercraft comprising:

a hull having a bottom hull and a top deck secured over the bottom hull, the bottom hull having a lowermost extent, the hull defining an engine compartment sized to contain an internal combustion engine for powering a jet propulsion unit, the top deck having a raised, longitudinally extending seat adapted to accommodate an operator in straddle fashion; and a sponson secured to each side of the bottom hull, the sponson having a fin for penetrating beneath the water, the sponson including an outward portion having a lower surface extending outwardly from the bottom hull, the outward portion lower surface positioned at a height above the lowermost extent of the bottom hull, the outward portion lower surface being formed, in part, by a removable sponson extension secured under the sponson.

6. A sponson, comprising:

an outward portion having a generally planar lower surface including an inner edge for mounting against a watercraft hull;

a fin for penetrating beneath the water, the fin extending downward from the outward portion lower surface along an outer edge of the outward portion lower surface; and a sponson extension removably mounted under the outward portion lower surface and extending from the inner edge to the outer edge of the outward portion lower surface.

7. A method for adjusting the handling characteristics of a personal watercraft having sponsons, wherein the sponsons terminate in a fin edge and include an outwardly extending portion having a lower surface, the method comprising changing the effective height of the sponson outwardly extending lower surface relative to the water without changing the position of the fin edge relative to the water.

8. A method as in claim 7, wherein the changing includes adding a thickness of material under the sponson outwardly extending portion.

9. A method as in claim 7, wherein the changing includes removing a separate thickness of material previously secured under the sponson outwardly extending portion.

10. A method as in claim 7, wherein the changing includes changing the effective height of the sponson outwardly extending portion by a substantially constant vertical amount along the length of the sponson by adding a slab of material and securing the material to the underside of the sponson.

11. A sponson for securing to a personal watercraft hull, the sponson comprising:

an outwardly extending portion for securing to the watercraft hull, the outwardly extending portion having a lower, water facing surface;

a downwardly extending fin for penetrating into the water secured to the outwardly extending portion; and a sponson extension removably mounted to the sponson outwardly extending portion water facing surface.

12. A sponson as in claim 11, wherein the sponson extension is reversibly secured to the water facing surface.

13. A sponson as in claim 11, wherein the sponson is formed so as to not float on water.

14. A personal watercraft comprising:

a hull; a deck secured over the hull; a straddle type seat operably secured to the watercraft; and a jet pump operably secured to the hull;

at least one sponson mounted on each side of the hull;

wherein the sponson has a fin for penetrating beneath the water;

wherein the hull has a lowermost extent;

wherein the sponson includes an outwardly extending portion having a lower surface extending outwardly from the personal watercraft hull;

further comprising means for changing the height of the lower surface relative to the hull lowermost portion not requiring changing the position of the sponson outwardly extending portion relative to the personal watercraft hull.

15. A personal watercraft as in claim 14, wherein the means for changing the height of the lower surface includes an aperture in the sponson lower surface for securing a sponson extension thereto.

16. A personal watercraft as in claim 14, wherein the aperture is threaded for receiving a bolt.

17. A personal watercraft as in claim 14, wherein the means for changing the height of the lower surface includes a sponson extension for securing a material thickness to the lower surface.

* * * * *